US011718514B2

(12) United States Patent
Doman et al.

(10) Patent No.: US 11,718,514 B2
(45) Date of Patent: Aug. 8, 2023

(54) HINGE ASSEMBLY

(71) Applicant: Marthinus H. Doman, Boyle (CA)

(72) Inventors: Marthinus H. Doman, Boyle (CA); Qinghai Jin, Edmonton (CA)

(73) Assignee: Marthinus H. Doman, Boyle (CA)

( * ) Notice: Subject to any disclaimer, the term of this patent is extended or adjusted under 35 U.S.C. 154(b) by 145 days.

(21) Appl. No.: 17/225,978

(22) Filed: Apr. 8, 2021

(65) Prior Publication Data

US 2022/0267132 A1 Aug. 25, 2022

(30) Foreign Application Priority Data

Feb. 20, 2021 (CA) ..... CA 3109753

(51) Int. Cl.
*E05D 11/00* (2006.01)
*B67B 7/16* (2006.01)
*B65D 81/38* (2006.01)

(52) U.S. Cl.
CPC ..... *B67B 7/16* (2013.01); *B65D 81/3813* (2013.01); *E05D 11/00* (2013.01); *E05Y 2600/626* (2013.01)

(58) Field of Classification Search
CPC ..... Y10T 16/54024; Y10T 16/540247; Y10T 16/54025; Y10T 16/540253; Y10T 16/540254; Y10T 16/5407; Y10T 16/54085; Y10T 16/5408; Y10T 16/5409; Y10T 16/54095; E05D 11/1007; E05D 11/1078; E05D 11/10; E05D 11/1014;
(Continued)

(56) References Cited

U.S. PATENT DOCUMENTS 4,090,727 A * 5/1978 Busch ..... E05C 19/105 292/111
4,746,151 A * 5/1988 Hoen ..... E05C 19/105 292/DIG. 31

(Continued)

FOREIGN PATENT DOCUMENTS

CA 2 858 272 8/2015

OTHER PUBLICATIONS

Aya Kitchens, Horizontal Hinge Side Adjustment, product webpage from ayakitchens com, accessed Oct. 15, 2020, 1 page.

(Continued)

*Primary Examiner* — Chuck Y Mah
(74) *Attorney, Agent, or Firm* — Lowe Graham Jones PLLC

(57) ABSTRACT

A hinge assembly for use on a structure having a first structure portion and a second structure portion. A first mounting plate configured to mount to the first structure portion and a second mounting plate configured to mount to the second structure portion. A hinge hingedly connecting the first mounting plate and the second mounting plate and configured to allow rotational movement of the first mounting plate and first structure portion relative to the second mounting plate and second structure portion between an open position and a closed position when the mounting plates are mounted to the corresponding structure portions. A tightener acting between the first mounting plate and the second mounting plate, the tightener configured to pull the first mounting plate towards the second mounting plate.

16 Claims, 8 Drawing Sheets

(58) Field of Classification Search
CPC ..... E05D 11/0027; E05D 5/00; E05D 7/1005; E05D 7/14; E05B 65/0075; E05B 65/0082; E05B 65/0085; E05Y 2900/21; E05Y 2600/626; B67B 7/16; B65D 81/3813
See application file for complete search history.

(56) References Cited

U.S. PATENT DOCUMENTS 4,758,031 A * 7/1988 Wolf ..... E05C 19/105 292/DIG. 31
5,213,381 A * 5/1993 Anderson ..... E05C 19/10 292/111
5,370,254 A * 12/1994 Hardigg ..... E05C 19/105 220/325
5,465,557 A 11/1995 Harte
5,669,638 A * 9/1997 Anderson ..... E05C 19/105 292/257
6,032,333 A 3/2000 Brüstle
6,050,616 A * 4/2000 Evans ..... E05C 19/105 292/109
6,179,350 B1 * 1/2001 Ely ..... E05C 19/14 292/285
6,379,626 B1 * 4/2002 Munson ..... B01L 3/50853 422/552
6,523,223 B2 * 2/2003 Wang ..... B62K 15/006 16/326
9,493,973 B2 11/2016 Mitchell et al.
10,174,531 B2 * 1/2019 Ro ..... E05C 5/02
10,626,643 B2 * 4/2020 Hatton ..... E05C 19/12
2013/0205625 A1 * 8/2013 Pilok ..... G09F 17/00 40/218

OTHER PUBLICATIONS

Black Jack Company, What is a European Hinge?, pamphlet from blackjackcompany.com, accessed Oct. 14, 2020, 1 page.
Coleman, Cam Latch, screen grabs from video from youtube.com, Apr. 27, 2018, 3 pages.
Fisher & Paykel, Adjust Hinge Tensioning Screws, product webpage from producthelp.fisherpaykel.com, Feb. 2018, 4 pages.
Securistyle, Variety of Accessories for Heavy Duty Windows, brochure from securistyle.com, Jan. 2014, 1 page.

* cited by examiner

Fig. 2
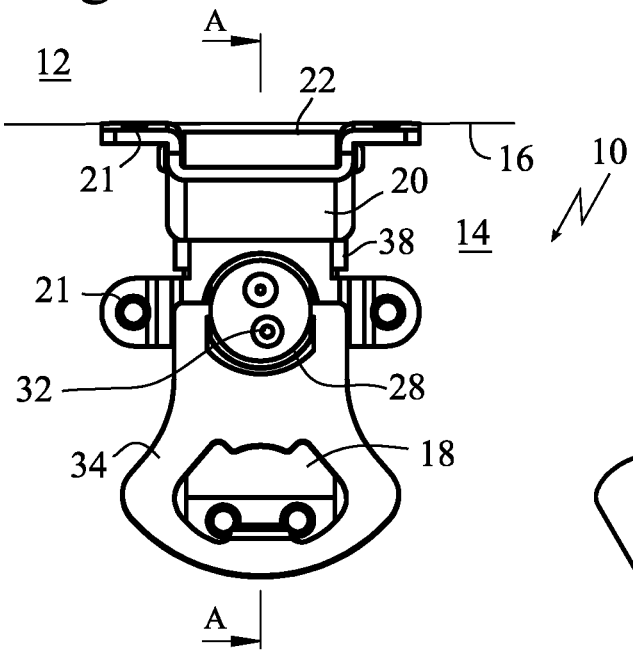
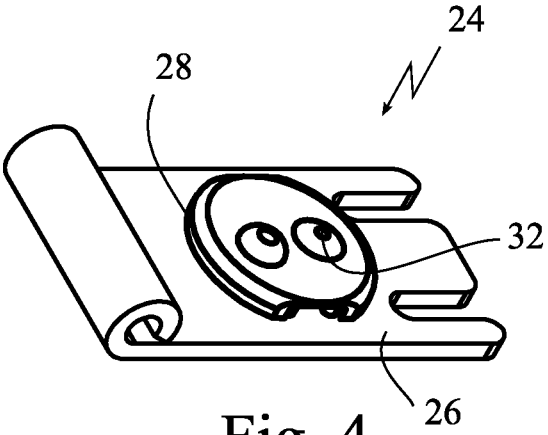
Fig. 4
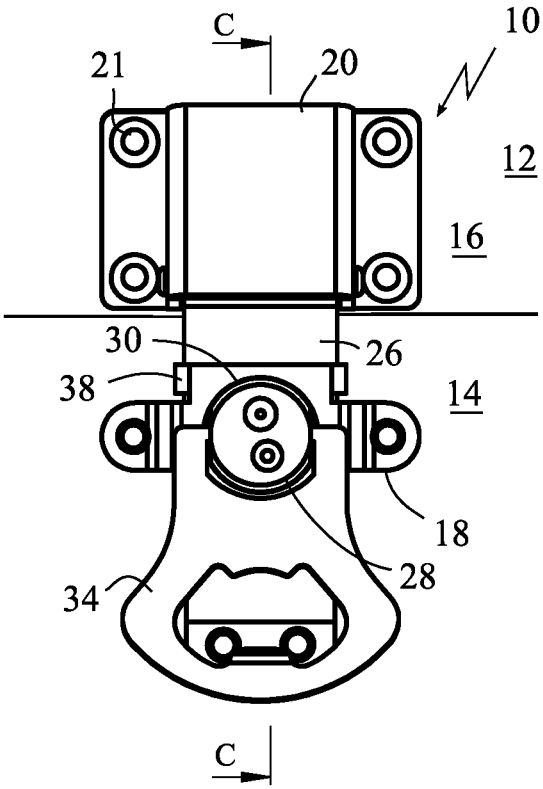
Fig. 3

SECTION A-A

Fig. 7
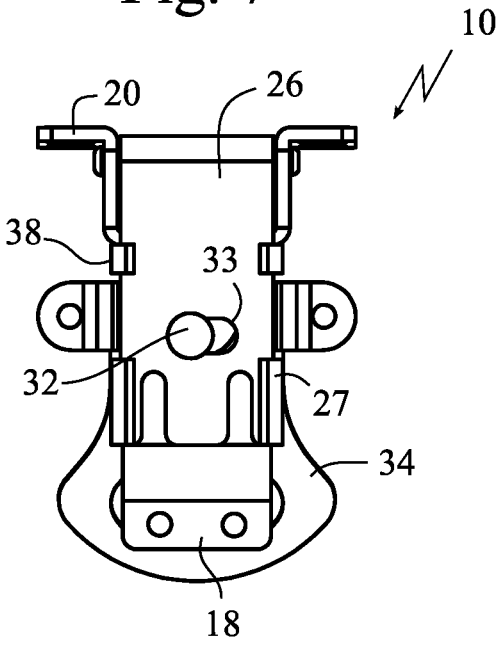
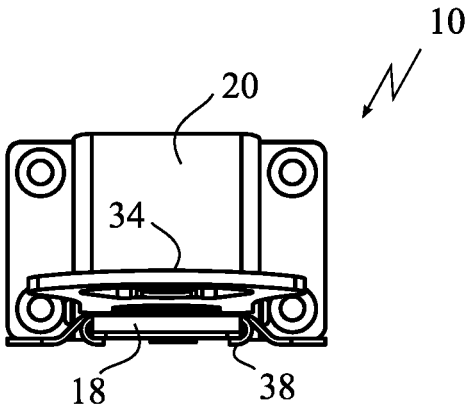
Fig. 8
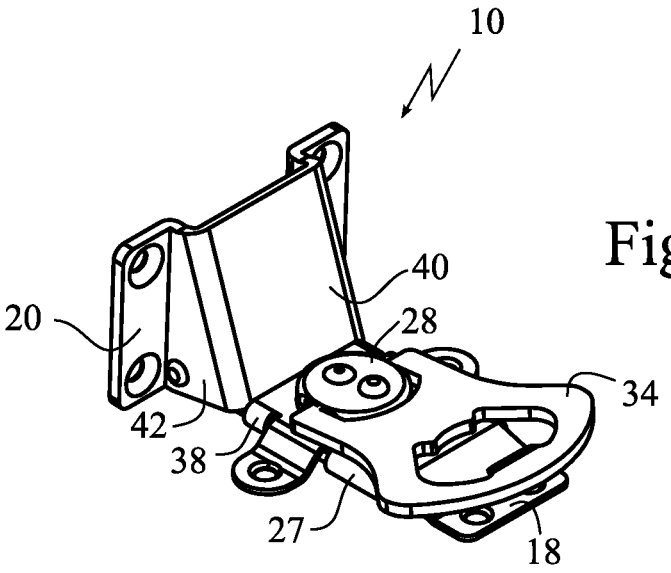
Fig. 9

SECTION C-C

Fig. 12
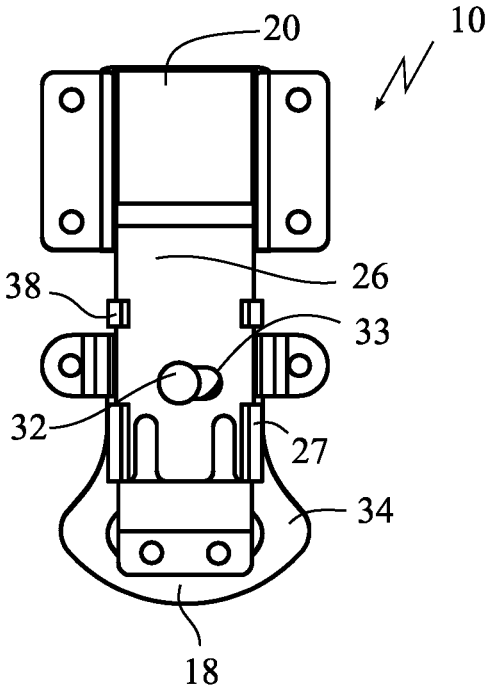
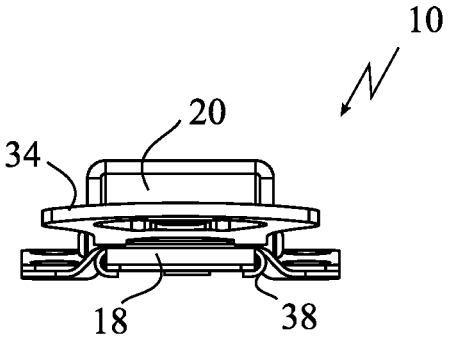
Fig. 13
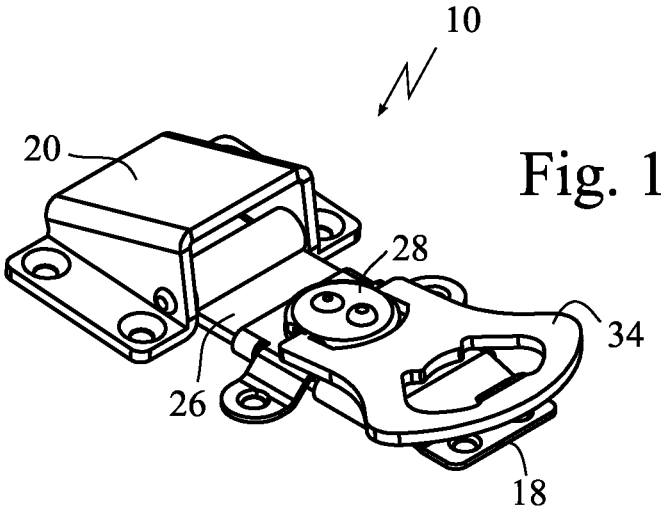
Fig. 14

Fig. 15
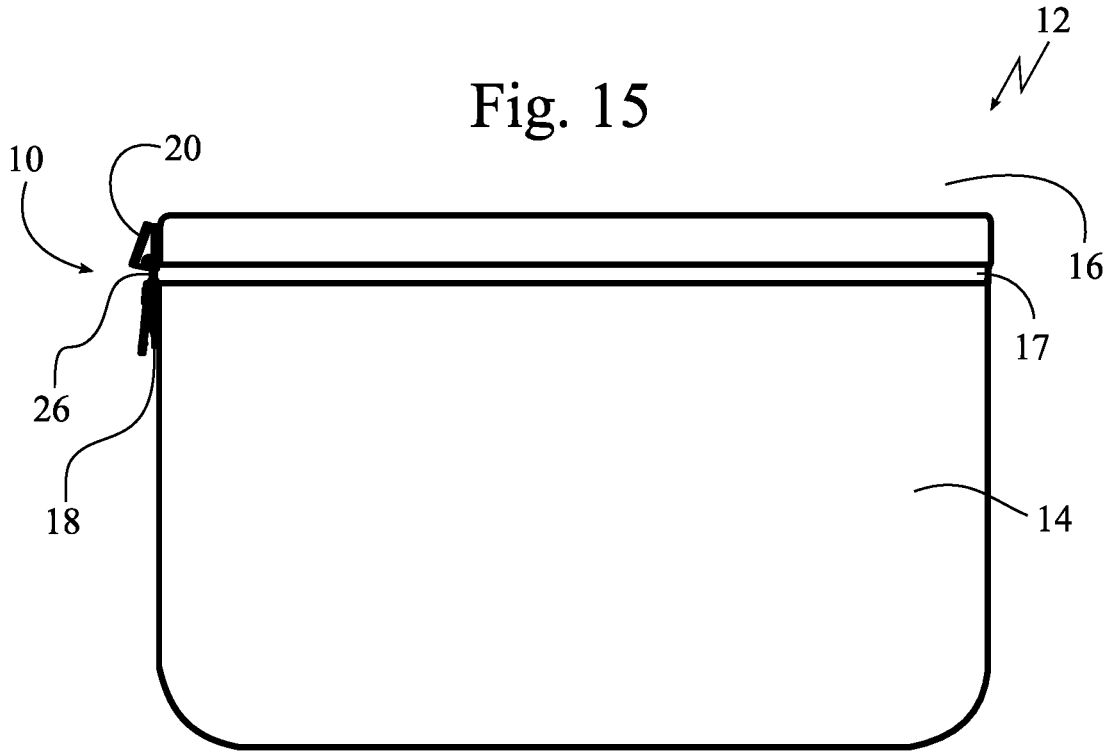
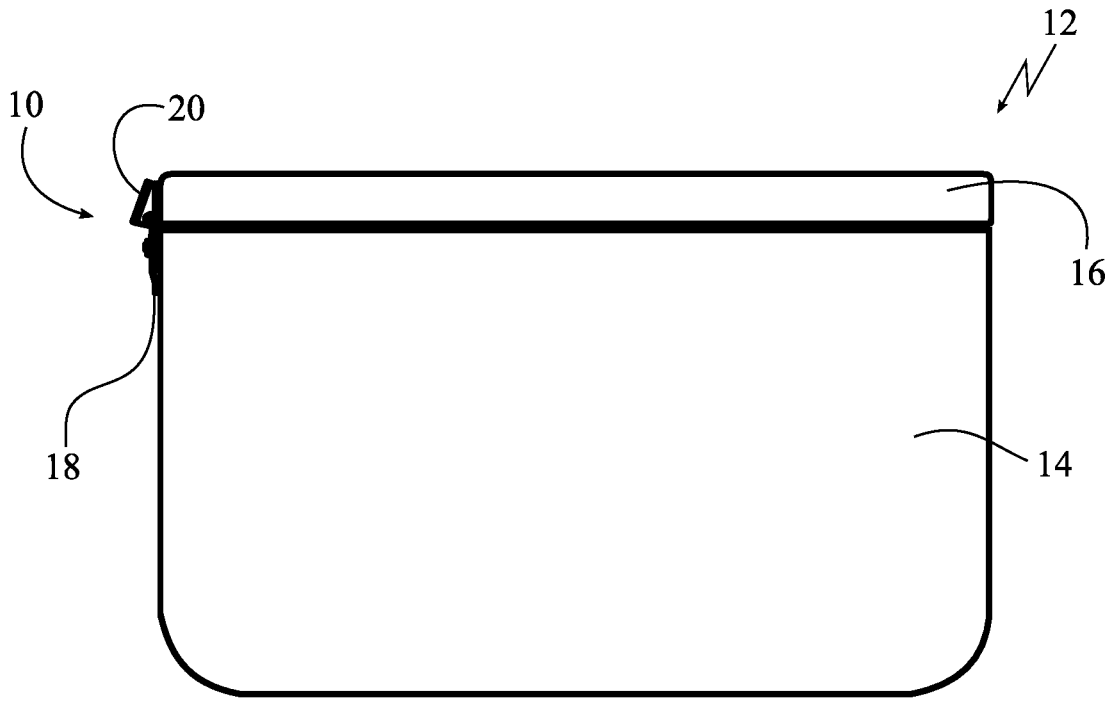
Fig. 16

HINGE ASSEMBLY

PRIORITY CLAIM

This application claims the benefit of priority from Canadian Patent Application No. 3,109,753 filed Feb. 20, 2021, the contents of which are incorporated by reference.

FIELD OF THE INVENTION

The invention relates to a hinge assembly for use on a structure such as a cooler.

BACKGROUND OF THE INVENTION

Hinges are used to rotatably connect two portions of a structure having at least two portions, such as coolers. For example, on a cooler, a hinge may be used to rotatably open the cooler and a latch may be used to hold the cooler closed on the opposite side from the hinge. Tightening of the latch to hold the cooler tightly closed may not be sufficient to maintain the internal temperature of the cooler for extensive periods. Maintaining a close seal is particularly important in vacuum-sealed containers such as the cooler described in Canadian Patent Application No. 2,858,272 published on Aug. 4, 2015.

SUMMARY OF THE INVENTION

There is provided in one embodiment a hinge assembly for use on a structure having a first structure portion and a second structure portion. A first mounting plate is configured to mount to the first structure portion and a second mounting plate is configured to mount to the second structure portion. A hinge hingedly connects the first mounting plate and the second mounting plate and is configured to allow rotational movement of the first mounting plate and first structure portion relative to the second mounting plate and second structure portion between an open position and a closed position when the mounting plates are mounted to the corresponding structure portions. A tightener acts between the first mounting plate and the second mounting plate. The tightener is configured to pull the first mounting plate towards the second mounting plate.

In various embodiments, there may be included any one or more of the following features: the structure is a cooler; the hinge hingedly connects between the second mounting plate and the tightener; the tightener comprises a sliding plate that is hingedly connected to the second mounting plate and slideably connected to the first mounting plate; the tightener further comprises a cam configured to cause sliding movement of the sliding plate relative to the first mounting plate; the cam comprises a rotating disc and a pin, and in which the sliding plate has an opening to receive the pin; the cam further comprises a handle; the handle comprises a bottle opener; the second mounting plate includes a second stop element configured to contact a first stop element of the first mounting plate when the structure and hinge assembly are in the open position to hold the structure in the open position; and the second stop element comprises a metal plate connecting two side walls of the second mounting plate, the hinge comprising a hinge pin extending between the two side walls.

There is provided in one embodiment a hinge assembly for use on a cooler. A first mounting plate is mounted to the body of the cooler. A second mounting plate is mounted to the lid of the cooler. A hinge hingedly connects the first mounting plate to the second mounting plate. The lid of the cooler is openable by movement of the hinge. A tightener acts between the first mounting plate and the second mounting plate configured to tighten the lid on the body when the lid is in a closed position.

In various embodiments, there may be included any one or more of the following features: the hinge hingedly connects between the second mounting plate and the tightener; the tightener comprises a sliding plate that is hingedly connected to the second mounting plate and slideably connected to the first mounting plate; a cam configured to cause sliding movement of the sliding plate relative to the first mounting plate; the cam comprises a rotating disc and a pin, and in which the sliding plate has an opening to receive the pin; the cam further comprises a handle; the handle comprises a bottle opener; the second mounting plate includes a second stop element configured to contact a first stop element of the first mounting plate when the lid is in an open position to hold the structure in the open position; and the second stop element comprises a metal plate connecting two side walls of the second mounting plate, the hinge comprising a hinge pin extending between the two side walls.

These and other aspects of the hinge assembly are set out in the claims.

BRIEF DESCRIPTION OF THE DRAWINGS

Preferred and alternative examples of the present invention are described in detail below with reference to the following drawings. Moreover, embodiments will now be described with reference to the figures, in which like reference characters denote like elements, by way of example, and in which:

FIG. 2 is a top view of the hinge assembly of FIG. 1 mounted to a structure in an open position;

FIG. 3 is a top view of the hinge assembly of FIG. 1 mounted to a structure in a closed position;

FIG. 4 is a side perspective view of a tightener of the hinge assembly of FIG. 1;

FIG. 7 is a bottom view of the hinge assembly of FIG. 2;

FIG. 8 is a back view of the hinge assembly of FIG. 2;

FIG. 9 is a side perspective view of the hinge assembly of FIG. 2;

FIG. 12 is a bottom view of the hinge assembly of FIG. 3;

FIG. 13 is a back view of the hinge assembly of FIG. 3;

FIG. 14 is a side perspective view of the hinge assembly of FIG. 3;

FIG. 15 is side view of a cooler in a closed position with a hinge assembly in an untightened position;

FIG. 16 is a side view of a cooler in a closed position with a hinge assembly in a tightened position.

DETAILED DESCRIPTION OF THE PREFERRED EMBODIMENT

In FIGS. 1-17, there is disclosed an embodiment of a hinge assembly 10 for use on a structure 12 having a first structure portion 14 and a second structure portion 16 (FIG. 15). In FIG. 2, the hinge assembly 10 is shown in an open position and in FIG. 3, the hinge assembly 10 is shown in a closed position. The hinge assembly may be described as a latch-hinge.

Figure 17:
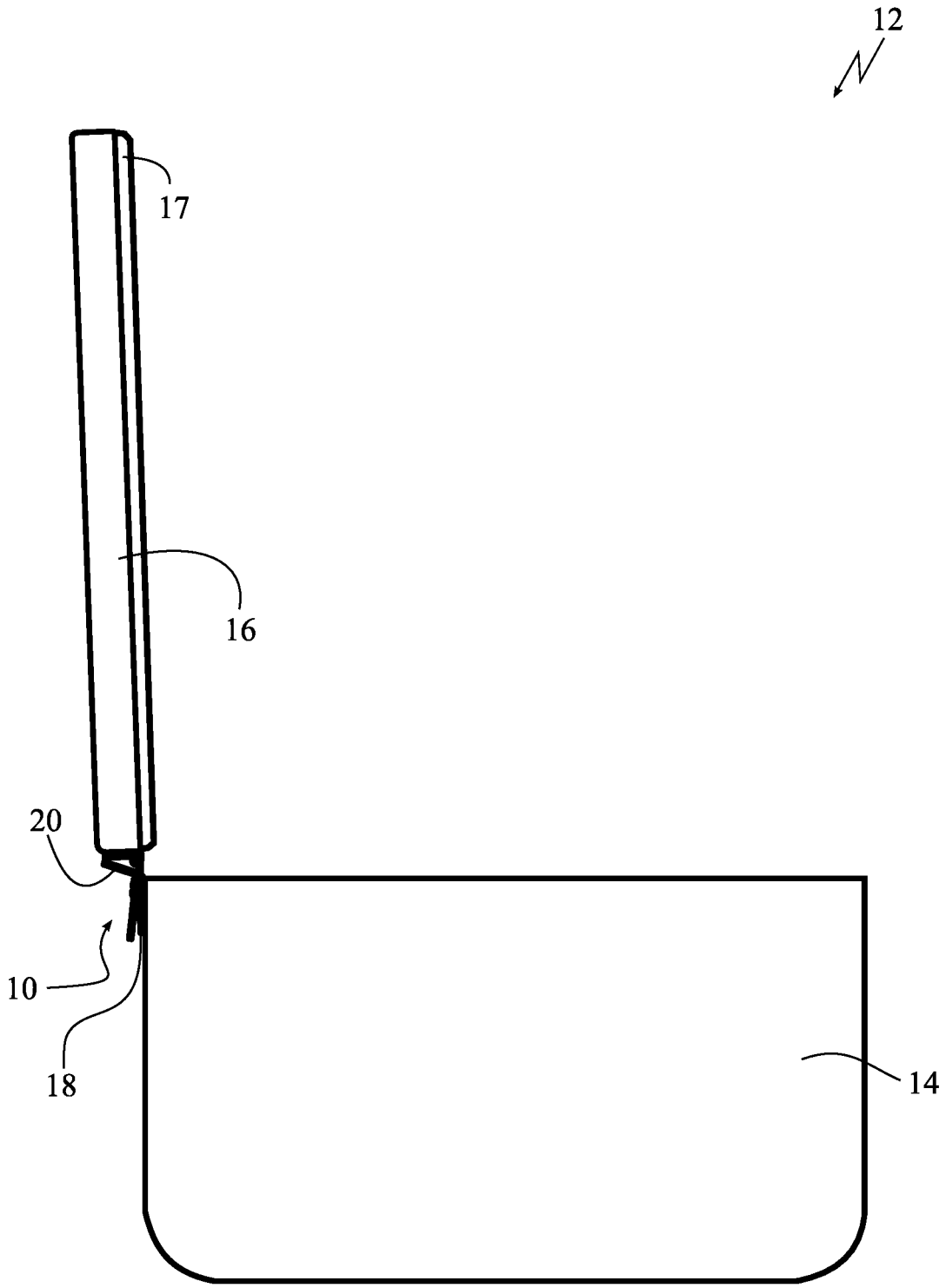
FIG. 17 is a side view of a cooler with a hinge assembly in an open position.

In FIGS. 15-17, the structure 12 is a cooler, and the first structure portion 14 is the base of the cooler and the second structure portion 16 is the lid of the cooler. In FIG. 15, the hinge assembly is in an untightened, closed position. The lid 16 of the cooler 12 may be flush to the body 14 of the cooler, and the lid 16 may be opened from this position, rotating the hinge assembly such that the lid 16 of the cooler 12 moves to the position shown in FIG. 17.

When the hinge assembly 10 is in the closed position shown in FIG. 15, the hinge assembly 10 may be tightened using tightener 24 to bring the lid 16 and the body 14 of the cooler 12 tightly together as shown in FIG. 16.

The cooler may have one or more hinge assemblies each used to connect the base 14 and lid 16 of cooler 12. A tightening latch (not shown) may be used on the opposite side of the cooler 12 from the hinge assembly 10, allowing for even tightening to be applied to each of these sides. Increasing the number of hinge assemblies 10 and latches used on the cooler 12 provides additional tightening which is better distributed and stronger than when using a single hinge assembly 10, however adding more hinge assemblies 10 or latches will increase the effort and time required to tighten or open the cooler 12, since each hinge assembly 10 or latch must be tightened and released.

It is preferable for coolers and other structures having multiple portions to have a hinge assembly bring the two portions of the structure together tightly. For example, having the base and lid of a cooler be tightly closed helps the interior of the cooler maintain its temperature for extensive periods.

As shown in FIG. 15, the cooler 12 may include a seal 17, which may be an integral part of the base 14 or lid 16, or may be attached to the base 14, lid 16 or both. The seal 17 is tightened using hinge assembly 10. For example, seal 17 may be made of a flexible material which deforms when force is applied. An airtight seal is particularly important for use in coolers in order to prevent loss of cooled air from the interior of the cooler and in vacuum-sealed containers to prevent air from entering. Vacuum-sealed containers, which includes vacuum-sealed coolers, provide an environment that strips bacteria of oxygen needed for survival. In a vacuum sealed cooler, this slows spoiling and prevents or reduces freezer burn. When used in a cooler, seal 17 is preferably also made of an insulative material. The insulative material may be any type of insulative material that is deformable, such as open celled foam or rubber. For example, the insulative material may be a rubber seal such as is used on refrigerator doors. Various shapes and configurations of seals may be used.

The base 14 and lid 16 of the cooler 12 may each be insulated, for example by having one or more layers of thermal insulation. Insulation may include material that when added to the cooler 12 provides an R-value of two or higher, for example 5 or higher, across the material from the exterior to the interior of the cooler. R-value is the measure of thermal resistance and is used in the building and construction industry. Insulation for the base 14 and lid 16 need not be deformable, and may include closed or open celled foam, wood, plastics and spray foam. For example, the insulation may be polyisocyanurate.

Figure 1:
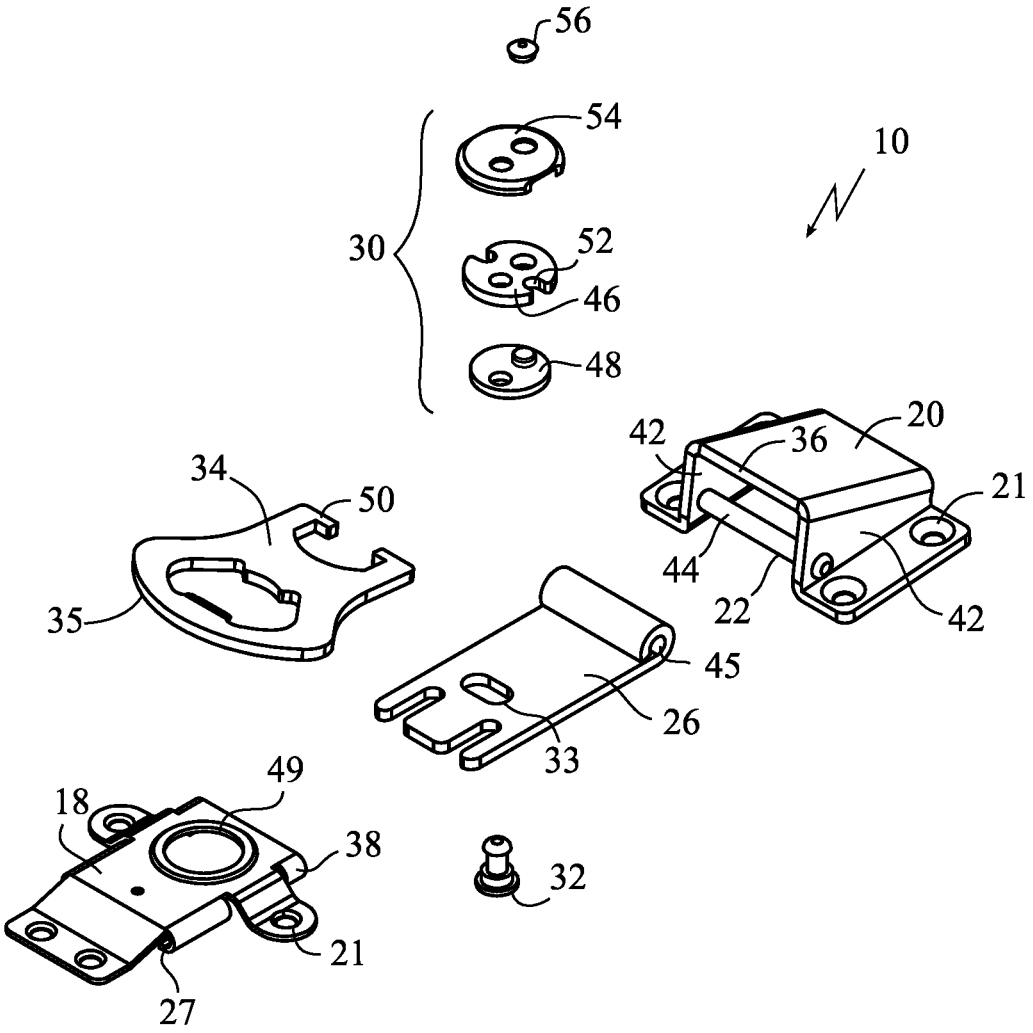
FIG. 1 is an exploded view of a hinge assembly.
Figure 5:
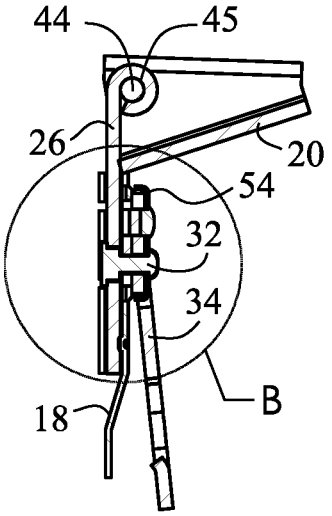
FIG. 5 is a side section view of the hinge assembly of FIG. 1 through the Section A-A of FIG. 2.
Figure 6:
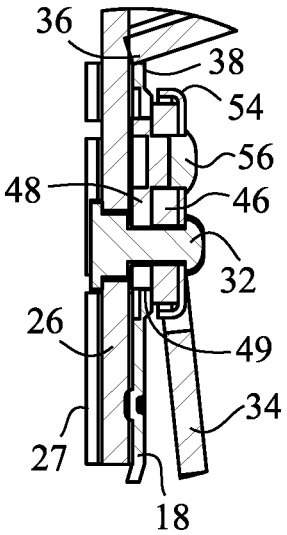
FIG. 6 is a detail view of the hinge assembly of FIG. 1 showing the Detail B of FIG. 5.
Figure 10:
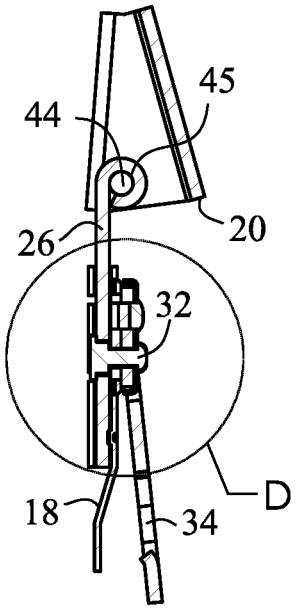
FIG. 10 is a side section view of the hinge assembly of FIG. 1 through the Section C-C of FIG. 3.
Figure 11:
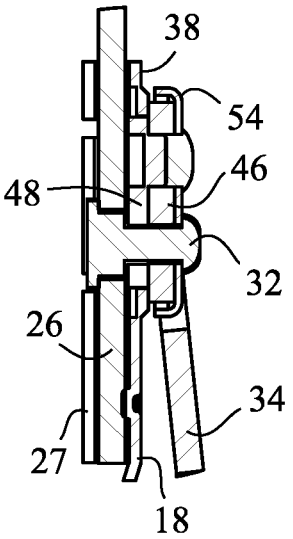
FIG. 11 is a detail view of the hinge assembly of FIG. 1 showing the Detail D of FIG. 3.

As shown in FIGS. 1-3, a first mounting plate 18 is mounted or configured to mount to the first structure portion 14 and a second mounting plate 20 is configured to mount to the second structure portion 16. A hinge 22 hingedly connects the first mounting plate 18 and the second mounting plate 20. The hinge 22 is configured to allow rotational movement of the first mounting plate 18 and first structure portion 14 relative to the second mounting plate 20 and second structure portion 16 between an open position (FIGS. 2 and 17) and a closed position (FIGS. 3, 15 and 16) when the mounting plates 18 and 20 are mounted to the corresponding structure portions 14 and 16. Referring to FIG. 17, lid 16 is openable by movement of the hinge 22.

A tightener 24, shown in FIG. 4, acts between the first mounting plate 18 and the second mounting plate 20. The tightener 24 is configured to pull the first mounting plate 18 towards the second mounting plate 20. Referring to FIGS. 15 and 16, the tightener 24 is configured to tighten the lid 16 on the body 14 of cooler 22 when the lid 16 is in a closed position. FIG. 16 shows the hinge assembly 10 in a tightened position after the first mounting plate 18 has been pulled towards the second mounting plate 20. Mounting plates 18 and 20 may be mounted using fasteners 21, for example using bolts (not shown) passing through fasteners 21. The mounting plates 18 may be mated to the structure by various fasteners, such as screws, adhesives or other mechanisms or connectors. Tightener 24 may have any shape or configuration provided that it is configured to pull the first mounting plate 18 towards the second mounting plate 20. For example, tightener 24 may be a draw latch or slide action latch.

As shown in FIGS. 1-14, the hinge 22 hingedly connects between the second mounting plate 20 and the tightener 24. The tightener 24 includes a sliding plate 26 that is hingedly connected to the second mounting plate 20 through the hinge 22 and slideably connected to the first mounting plate 18, for example through sliding tabs 27. The sliding tabs 27 may have any shape or configuration provided they restrict movement between the second mounting plate 20 and sliding plate 26 to sliding relative to each other.

As shown in FIG. 4, the tightener 24 may include a cam 28 configured to cause sliding movement of the sliding plate 26 relative to the first mounting plate 18. The cam 28 may include a rotating disc 30 and a pin 32. The sliding plate 26 has an opening 33 to receive the pin 32. As shown in FIG. 2, the cam 28 may have a handle 34. The handle 34 may be designed to include a bottle opener 35 (FIG. 1). Opening 33 may have any shape or configuration, provided that it restricts movement of the pin 32 relative to the sliding plate 26 in the direction the sliding plate moves sufficiently that movement of the pin 32 in this direction causes movement of the sliding plate 26, and also permits the movement of pin 32 relative to the sliding plate 26 along an axis parallel to the rotational axis of the hinge sufficiently to allow the rotational movement of the rotating disc 30.

Cam 28 may have any configuration or shape provided that it converts rotational movement of the cam 28 to reciprocal motion of the sliding plate 26 alternately towards and away from the first mounting plate 18 and second mounting plate 20. For example, the cam 28 may be ovular or pear-shaped.

FIGS. 5-9 show the hinge assembly 10 in an open, untightened position. FIGS. 10-14 show the hinge assembly 10 in a closed, untightened position.

As shown in FIGS. 5-9, the second mounting plate 20 includes a second stop element 36 configured to contact a first stop element 38 of the first mounting plate 18 when the structure 12 and hinge assembly 10 are in the open position. The first and second stop elements may cooperate to hold the structure 12 in the open position. In addition, the cooperating steps may prevent the tightener 24 from pulling the first mounting plate 18 towards the second mounting plate 20 when the structure 12 and hinge assembly 10 are in the open position or may prevent force from being applied to the tightener when the cooler and hinge assembly are in the open position. The second stop element 36 may include a metal plate 40 connecting two side walls 42 of the second mounting plate 20. Various configurations and shapes of stop elements 36 and 38 may be used, so long as they provide the desired benefits. Alternatively, no stop elements may be used, stop elements may be placed on the lid and side separate from the hinge assembly 10, or other mechanisms may be used to hold the structure 12 in an open position, such as chains on the sides of the structure.

Hinge 22 may include a hinge pin 44 extending between side walls 42. The hinge pin 44 may be inserted into a hinge slot 45 such that the hinge slot 45 is rotatable around the hinge pin 44. The hinge slot 45 may be attached to or form part of sliding plate 26. Hinge 22 may have any configuration or shape provided that it rotatably connects the second mounting plate 20 and sliding plate 26. For example, hinge 22 may have one or more hinge slots extending from each of the second mounting plate 20 and sliding plate 26, where the hinge slots are offset from each other to allow pin 44 to sit within each of the hinge slots. Pin 44 may removable or non-removable.

The rotating disc 30 may be a single part or may include separate elements. As shown in FIG. 1, the rotating disc 30 may include a driving disc 46 and pivot disc 48, where driving disc 46 is designed to be driven by handle 34 and pivot disc 48 is configured to rotate within mounting plate opening 49. The handle 34 may drive driving disc 46 for example using handle tabs 50 which insert into disc slots 52 in driving disc 46. Pin 32 may be configured to pass through each of opening 33, driving disc 46, and pivot disc 48 such that rotation of the driving disc 46 drives the pin 32 within opening 33 to cause sliding movement of the sliding plate 26 relative to the first mounting plate 18. A cover 54 may be used to cover driving disc 46. A cap 56 may be used to fill a second opening in cover 54.

The type of cooler 12 shown in FIGS. 15-17 may be a form of insulated chest, also known as an ice chest. Ice cubes are most commonly placed in coolers to help the internal contents, such as food, stay cool. Ice packs may also be used.

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A hinge assembly for use on a structure having a first structure portion and a second structure portion, the hinge comprising:

a first mounting plate configured to mount to the first structure portion and a second mounting plate configured to mount to the second structure portion, a hinge hingedly connecting the first mounting plate and the second mounting plate and configured to allow rotational movement of the first mounting plate and first structure portion relative to the second mounting plate and second structure portion between an open position and a closed position when the mounting plates are mounted to the corresponding structure portions;

a tightener acting between the first mounting plate and the second mounting plate, the tightener configured to pull the first mounting plate towards the second mounting plate; and wherein the second mounting plate includes a second stop element configured to contact a first stop element of the first mounting plate when the structure and hinge assembly are in the open position to hold the structure in the open position, the second stop element comprises a metal plate connecting two side walls of the second mounting plate, and the hinge comprising a hinge pin extending between the two side walls.

2. The hinge assembly of claim 1 in which the structure is a cooler.

3. The hinge assembly of claim 1 in which the hinge hingedly connects between the second mounting plate and the tightener.

4. The hinge assembly of claim 3 in which the tightener comprises a sliding plate that is hingedly connected to the second mounting plate and slideably connected to the first mounting plate.

5. The hinge assembly of claim 4 in which the tightener further comprises a cam configured to cause sliding movement of the sliding plate relative to the first mounting plate.

6. The hinge assembly of claim 5 in which the cam comprises a rotating disc and a pin, and in which the sliding plate has an opening to receive the pin.

7. The hinge assembly of claim 5 in which the cam further comprises a handle.

8. The hinge assembly of claim 7 in which the handle comprises a bottle opener.

9. The hinge assembly of claim 5 in which the cam comprises a rotating disc and a pin, and in which the sliding plate has an opening to receive the pin, and the cam further comprises a handle.

10. A hinge assembly for use on a cooler, the hinge assembly comprising:

a first mounting plate mounted to the body of the cooler;

a second mounting plate mounted to the lid of the cooler, a hinge hingedly connecting the first mounting plate to the second mounting plate, in which the lid of the cooler is openable by movement of the hinge;

a tightener acting between the first mounting plate and the second mounting plate configured to tighten the lid on the body when the lid is in a closed position; and wherein the second mounting plate includes a second stop element configured to contact a first stop element of the first mounting plate when the lid is in an open position to hold the structure in the open position, the second stop element comprises a metal plate connecting two side walls of the second mounting plate, and the hinge comprising a hinge pin extending between the two side walls.

11. The hinge assembly of claim 10 in which the hinge hingedly connects between the second mounting plate and the tightener.

12. The hinge assembly of claim 11 in which the tightener comprises a sliding plate that is hingedly connected to the second mounting plate and slideably connected to the first mounting plate.

13. The hinge assembly of claim 12 further comprising a cam configured to cause sliding movement of the sliding plate relative to the first mounting plate.

14. The hinge assembly of claim 13 in which the cam comprises a rotating disc and a pin, and in which the sliding plate has an opening to receive the pin.

15. The hinge assembly of claim 14 in which the cam further comprises a handle.

16. The hinge assembly of claim 15 in which the handle comprises a bottle opener.

* * * * *